United States Patent [19]

Müller et al.

[11] 4,404,548

[45] Sep. 13, 1983

[54] METHOD FOR TRANSMITTING MEASURING VALUES IN A FIRE ALARM SYSTEM AND APPARATUS FOR THE PERFORMANCE OF THE AFORESAID METHOD

[75] Inventors: Peter Müller, Oetwil am See; Eugen Schibli; Andreas Scheidweiler, both of Uerikon; Jürg Muggli, Männedorf, all of Switzerland

[73] Assignee: Cerberus AG, Männedorf, Switzerland

[21] Appl. No.: 271,187

[22] Filed: Jun. 8, 1981

[30] Foreign Application Priority Data

Jun. 23, 1980 [CH] Switzerland ..... 4803/80

[51] Int. Cl.[3] ..... G08B 26/00

[52] U.S. Cl. ..... 340/505; 340/508; 340/511; 340/518; 340/825.54

[58] Field of Search ..... 340/505–512, 340/518, 516, 526, 531, 536, 537, 825.05, 825.06, 825.07, 825.1, 825.12, 825.13, 825.54; 343/6.5 R, 6.8 R; 179/5 R, 5 P

[56] References Cited

U.S. PATENT DOCUMENTS 3,603,949 9/1971 Walthard ..... 340/511
3,716,834 2/1973 Adams ..... 340/505

FOREIGN PATENT DOCUMENTS 2533382 7/1980 German Democratic Rep. .

*Primary Examiner*—Donnie L. Crosland
*Attorney, Agent, or Firm*—Werner W. Kleeman

[57] ABSTRACT

In a fire alarm system individual fire alarms are connected in series by reporting lines with a central signal station. In order to be able to connect a greater number of fire alarms with the individual reporting or signaling lines and/or in order to be able to dispatch an increased amount of current through the reporting lines, the reporting or signaling lines from the last fire alarm of a line are returned back to the central signal station in the form of a ring circuit or loop. Upon the absence of signals at a reporting line an interrogation device is reversed, so that there can be ensured that in the event of a line disturbance or breakdown of a fire alarm the remainder of the fire alarms still can be utilized for giving a signal. The individual fire alarms are structured such that during assembly the inputs and outputs can be mutually interchanged.

12 Claims, 4 Drawing Figures

METHOD FOR TRANSMITTING MEASURING VALUES IN A FIRE ALARM SYSTEM AND APPARATUS FOR THE PERFORMANCE OF THE AFORESAID METHOD

BACKGROUND OF THE INVENTION

The present invention relates to a new and improved method of transmitting measuring or measurement values in a fire alarm system, wherein the measuring values determined by individual fire alarms located in a series configuration at reporting or signaling lines are delivered to a central signal station and at that location are interlinked in order to obtain differentiated disturbance or alarm signals.

Automatic fire alarm installations are assigned the task of recognizing at an incipient stage fires or combustion processes, in order to render possible effective fire fighting. One requirement which is placed upon the fire alarms is that they possess high sensitivity in order to be able to use for fire detection purposes traces of the products produced during a combustion process or fire. However, going hand-in-hand with the increase in the sensitivity of the fire alarms is also the undesirable tendency for such fire alarms to trigger false alarms. Therefore, at the central signal station it is frequently difficult to differentiate between an actual alarm and a false alarm.

In order to overcome such shortcomings it has already been proposed to transmit to the central signal station, instead of an alarm signal, a measuring or measurement value which is analogous to a characteristic combustion parameter which is to be measured and determining at the central signal station whether there has been encountered an actual fire or merely a malfunction in the alarm system. This is possible because by comparison of the measuring magnitudes or values of different fire alarms there can be obtained an appreciably more exact determination.

A prerequisite for useful evaluation of the fire alarm signals at the central signal station is, however, that there be clearly ascertained the origin of the signals, i.e. the fire alarms must be identifiable, in other words addressable.

In more recent times there have been developed a number of fire alarm systems wherein identification of the fire alarms is possible and there can be accomplished transmission of the measuring value to the central signal station. However, the expenditure in circuitry is extremely great and the installation is associated with technological difficulties.

One of the primary drawbacks of this technique resides in the fact that for determining the fire alarm address it is necessary to undertake at each fire alarm an individual adjustment or setting. Consequently, there prevails the danger of faulty addressing of the fire alarms and the thus related false identification of the fire alarms.

In order to overcome such drawback there has been proposed in German Pat. No. 2,533,382 a method for transmitting measuring values in a fire alarm system wherein the measuring values which are delivered by individual fire alarms located in a series configuration at the reporting or signaling lines are transmitted in the form of analog signals to a central signal station and at that location are linked in order to obtain differentiated disturbance or alarm reporting signals. At the beginning of one of each interrogation cycle all of the fire alarms are disconnected from the alarm reporting line by a potential change and then again connected in a predetermined sequence in a manner such that each fire alarm, following a time-delay corresponding to its measuring value, additionally connects the momentarily next following fire alarm to the line voltage. Furthermore, at the central signal station there is derived the relevant fire alarm address from the number of preceding increases in the line current and the measuring value is derived from the length of the related switching time-delay.

Yet, this prior art method is associated with three fundamental shortcomings:

Firstly, due to the series arrangement of the fire alarms there are encountered increased costs and time during installation of the fire alarms in order to ensure that the fire alarms are properly connected. Even if there is utilized a two-wire system, nonethless the fire alarm still possesses three terminals and care must be taken to ensure that the inbound wire and the outbound wire are not erroneously interchanged. In contrast to classical installation techniques for two-wire systems this is associated with increased difficulties in installing the fire alarms and also constitutes a source for errors.

Secondly, the number of fire alarms per line is limited by the resistance of the switch which is connected in series.

Thirdly, upon malfunction of a fire alarm or in the event of interruption or short-circuit of the line it is necessary for at least part of the fire alarms of a line to be placed out of operation.

SUMMARY OF THE INVENTION

Therefore, with the foregoing in mind it is a primary object of the present invention to provide a new and improved method of, and apparatus for, transmitting measuring values in a fire alarm system in a manner which is not associated with the aforementioned drawbacks and limitations of the prior art proposals.

Another and more specific object of the present invention aims at providing a new and improved method of transmitting measuring values in a fire alarm system and an apparatus for the performance of such method, wherein there can be effectively avoided the previously discussed shortcomings and disadvantages of the heretofore known solutions, i.e. the transmission of measuring values is also then possible if a fire alarm in a reporting or signaling line is inoperative or a reporting line is interrupted or short-circuited.

Still a further significant object of the present invention aims at providing a novel method and apparatus of the character described which enables connecting the fire alarms with the reporting or signaling lines without the need to pay particular attention to whether or not the inputs and outputs of the reporting or signaling lines are inadvertently interchanged and which also enables dispatching an increased current through the reporting or signaling lines or connecting a larger number of fire alarms at the reporting lines.

Now in order to implement these and still further objects of the invention which will become more readily apparent as the description proceeds, the invention contemplates returning the reporting lines from the last fire alarm of a line back to the central signal station and upon absence of fire alarm signals the interrogation device for the related fire alarm line is reversed. This ensures that in the event of a line disturbance or malfunction of a fire alarm the remainder of the fire alarms of such reporting or signaling line still can be employed for giving a signal.

According to a preferred embodiment of the inventive method, following the transmission of the measuring or measurement value of the last fire alarm a line current is infed into the reporting or signaling lines from both ends. Due to the connection of the reporting or signaling lines at both ends there is achieved the result that the current for powering the fire alarms is practically quadrupled.

According to a further embodiment of the inventive method the transmission of the measuring value is accomplished in the delay time between turning on two fire alarms. The time-delay is not dependent upon the measuring value and remains essentially constant.

Directly following the turning-on or activation of a fire alarm, i.e. when the connection to the central signal station has been established, there is accomplished the conversion of the measuring value into a coded pulse train or sequence or an alternating-current voltage signal whose frequency is dependent upon the measuring value. It should however be readily understood that the duration of the measuring value signal must be shorter than the time-delay.

Not only is the invention concerned with the aforementioned method aspects, but as alluded to above, also relates to apparatus for the performance of such method. One advantageous fire alarm construction comprises a sensor which is sensitive to a combustion or fire parameter, a measuring value transducer, a time-delay element and a bidirectional switch which always then connects the next fire alarm to the reporting or signaling line.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
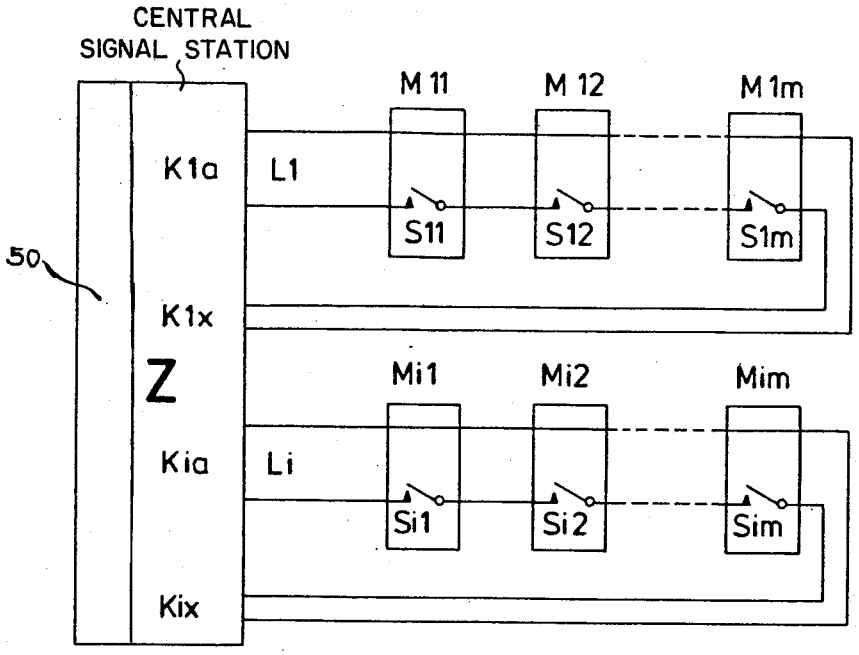
FIG. 1 illustrates an exemplary embodiment of a fire alarm system suitable for performance of the inventive method.

Describing now the drawings, in FIG. 1 there is illustrated purely by way of example and not limitation a possible construction of a fire alarm system for carrying out the inventive transmission method. Alarm signaling or reporting lines L1 . . . Li lead from the terminals K1a . . . Kia of a central signal station Z.

Connected in each case with such alarm signaling or reporting lines L1 . . . Li are a number of fire alarms M11 . . . M1m. The fire alarms M11 . . . M1m essentially contain, as will be explained more fully hereinafter, apart from the combustion-parameter sensitive sensors a measuring value transducer, a time-delay element and a bidirectional switch. In each case two lines or conductors of the last fire alarm of a reporting or signaling line are returned back to the terminals K1x . . . Kix of the central signal station Z. After applying the line potential or voltage to the terminals K1a a timing element begins to run in the fire alarm M11. After a certain time-delay the switch S11 closes and applies the line voltage to the fire alarm M12, where likewise there again begins to run a time-delay element. In this manner it is possible to successively close all of the switches of the fire alarms of an alarm signaling or reporting line. This operation can be periodically repeated, so that the fire alarms of a reporting line are cyclically interrogated. After application of the line voltage to a fire alarm and upon closing the related switch there can be accomplished transmission of the measuring value of the sensor to the central signal station Z.

At the end of an interrogation cycle there are charged storage capacitors contained in the fire alarms. These storage capacitors ensure for the energy or power supply of the fire alarms during system-governed interruptions.

During normal operation, i.e. in the undisturbed state, a suitable reporting line-evaluation circuit, generally indicated by reference character 50 in FIG. 1, of the central signal station Z is connected with the terminals Kia of the related lines.

The occurrence of a line disturbance or the malfunction or breakdown of a fire alarm is detected in the central signal station Z in that the interrogation cycle is interrupted. When this happens there is accomplished an automatic switching of the alarm line-evaluation circuit 50 to the terminals Kix of the related alarm signaling or reporting lines. The interrogation of the fire alarms now is accomplished in the reverse direction until reaching the disturbance or malfunctioning location.

By periodically switching the alarm line-evaluation circuit 50 from the terminals Kia to the terminals Kix there is achieved the beneficial result that even in the event of a disturbance situation the still intact fire alarms of a fire alarm line can transmit their measuring values to the central signal station Z.

Figure 2:
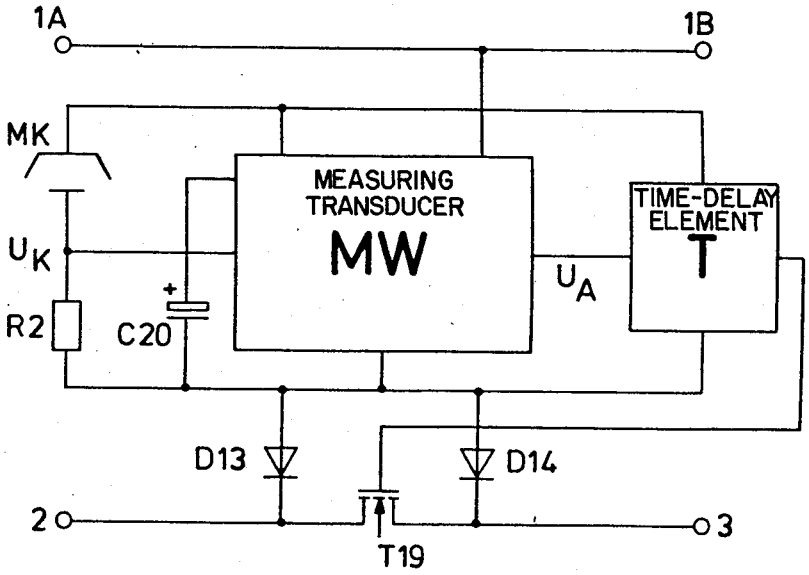
FIG. 2 illustrates a circuit arrangement for a fire alarm wherein the time-delay is dependent upon the measuring or measurement value.

Continuing, in FIG. 2 there is illustrated by way of example the circuit arrangement of a fire alarm M wherein the time-delay is controlled by the measuring value.

In this case there is used as the sensor a conventional smoke-sensitive measuring ionization chamber MK, the current of which produces at the external resistance R2 a voltage or potential $U_K$. This potential $U_K$ is infed to the not particularly referenced input of a measuring transducer MW, whose output voltage $U_A$ acts upon the timing or time-delay element T. A bidirectional switch T19 serves for further transmitting or switching-through the line potential to the next following fire alarm of the chain i.e. series arrangement of fire alarms. The diodes D13 and D14 serve for rendering the system symmetrical, i.e. during installation of the fire alarm it is not necessary to pay particular attention to the correct sequence of the terminals or connection 2 and 3.

Upon application of the line voltage or potential at the terminals 1A, 1B and 2 or 1A, 1B and 3 the bidirectional switch T19 constituted by a transistor initially is in its non-conductive or blocked state. At the same time the timing element or time-delay element or time-delay circuit T is activated and after a certain time-delay, governed by the value of the potential $U_A$, opens the transistor T19, i.e. renders the same conductive, and therefore switches-through the line potential or voltage to the next fire alarm in the chain or series arrangement.

Upon application of the line potential there is furthermore switched-in a resistance in the fire alarm which produces a current increase which is evaluated at the central signal attention Z for determining the fire alarm address.

Figure 3:
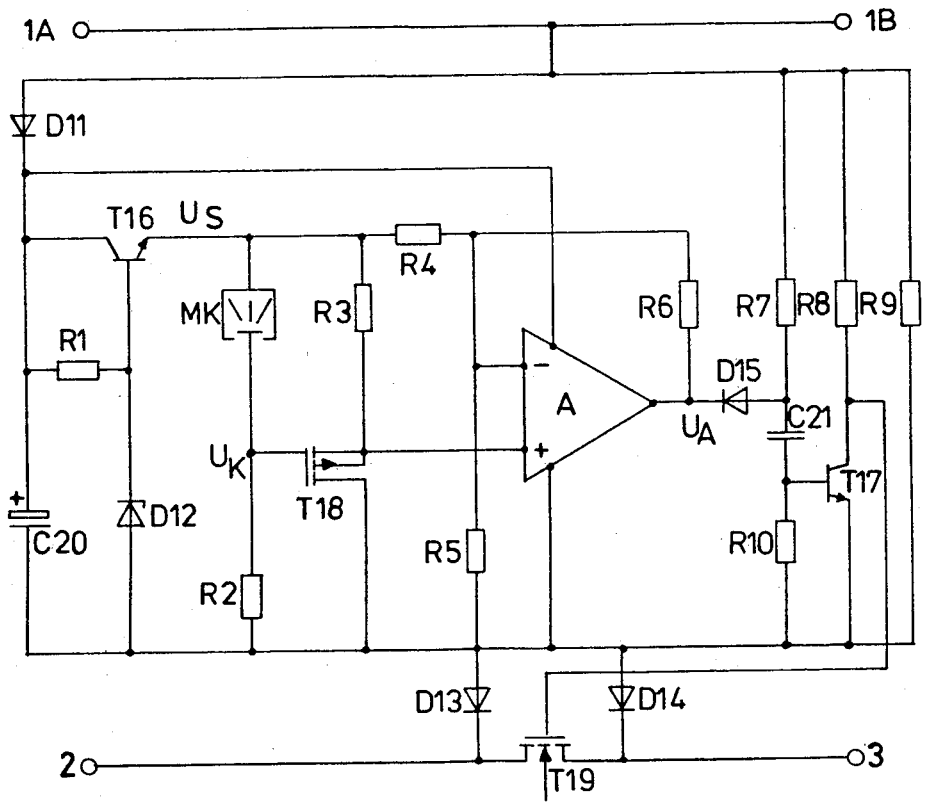
FIG. 3 illustrates a preferred embodiment of the circuit arrangement of FIG. 2.

FIG. 3 illustrates a circuit diagram of a preferred embodiment of fire alarm according to the arrangement of FIG. 2. Once again by way of example and not limitation there is used a fire alarm having a measuring ionization chamber MK constituting the smoke-sensitive sensor. This measuring ionization chamber MK is connected in series with a comparison resistor R2, in place of which there also could be utilized a reference ionization chamber as is quite well known in this technology, and at which there is applied the stabilised voltage or potential $U_S$. A capacitor C20 is charged by means of the rectifier D11 and bridges the system-governed peiodic interruptions in the line voltage. A transistor T16 in conjunction with the resistance or resistor R1 and the Zener diode D12 forms in known manner a voltage stabiliser for generating the stabilized voltage $U_S$. The transistor 18, for instance a MOSFET transistor serves an an impedance converter, i.e. it transmits the output voltage $U_K$ of the sensor to the not particularly referenced input of an operational amplifier A, the operating or work input of which is goverened by the resistances R4, R5, and R6. The output voltage $U_A$ of the operational amplifier A is proportional to the sensor voltage or potential $U_K$.

In the normal operating state the transistor T17 is not conductive, and therefore the gate terminal of the bidirectional switch T19 is at the potential of the terminal 1, so that the transistor T19 is maintained in its conductive state. The potential or voltage across the capacitor C21 is limited by means of the diode D15 approximately to the value of the amplifier output voltage $U_A$. Now if at the start of an interrogation cycle the line voltage drops to null, then the capacitor C21 discharges to null through the resistances R7, R9 and R10. Upon again turning-on the line voltage a charging current flows through the resistance R7 to the capacitor C21 and further flows through the resistance or resistor R10. Consequently, the transistor T17 becomes conductive and there flows an additional current through the resistance R8. The gate potential of the transistor T19 suddenly switches below the threshold voltage of the field-effect transistor and thus blocks the transistor T19. Now after the capacitor C21 has charged by means of the resistor or resistance R7 to the output voltage $U_A$ of the amplifier no further charging current flows to the capacitor C21 which, in turn, causes the transistor T17 to block. The gate of the transistor T19 again jumps to the potential of the terminal 1 and therefore places the switching transistor T19 into its conductive state.

The diodes D13 and D14 ensure for a symmetrical energy supply or powering of the electronic components of the fire alarm which, in conjunction with the symmetry characteristics of the transistor T19, render possible the selective powering of the terminal 2 or the terminal 3. In similar fashion there can be conceived circuit arrangements having other symmetrical switching elements instead of the transistor T19. As a bidirectional switch there also can be used JFET's or relays.

Figure 4:
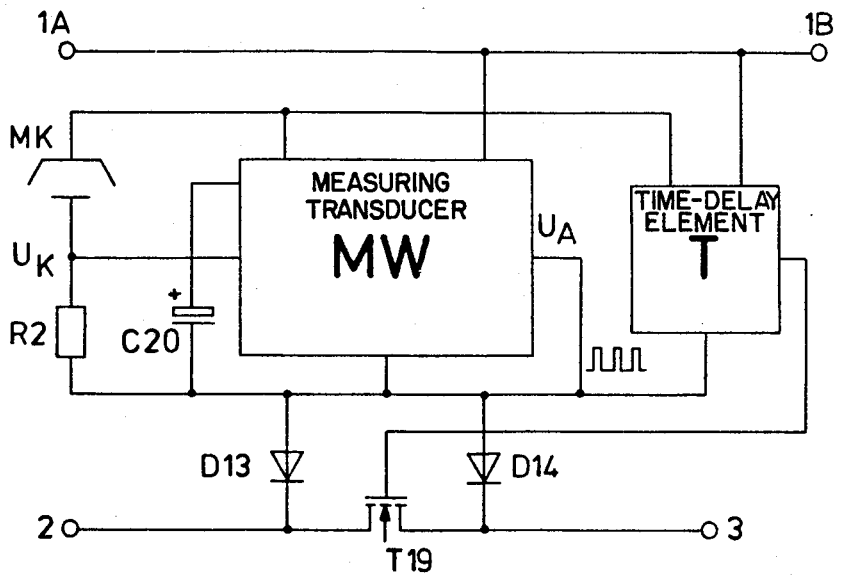
FIG. 4 illustrates a circuit arrangement for a fire alarm whose time-delay is independent of the measuring value.

Finally, in FIG. 4 there is illustrated an embodiment of the inventive method and apparatus for the performance thereof wherein the time-delay is independent of the measuring value. The mode of operation, with this system design, is similar to that described above in conjunction with the circuitry of FIG. 2. Here however the output voltage $U_A$ of the measuring transducer MW does not control the timing element or time-delay element T. Directly after applying the line voltage to the terminals 2 or 3, i.e. when the connection to the central signal station Z has been established, there is accomplished the conversion of the measuring value into a coded pulse train or an alternating-current voltage signal, the frequency of which is governed by the measuring value. This signal is received at the central signal station Z and appropriately evaluated. At the same time the time-delay element T is placed into operation and after a fixed preselected time turns-on the transistor T19 and thus further switches-through the line voltage or potential to the next fire alarm of the chain or series arrangement. It should be readily understood that the duration of the measuring value signal must be shorter than the switch-on time-delay. This embodiment of the invention has the advantage that it is possible to separate the measuring value transmission and the fire alarm addressing.

While there are shown and described present preferred embodiments of the invention, it is to be distinctly understood that the invention is not limited thereto, but may be otherwise variously embodied and practiced within the scope of the following claims.

Accordingly,

What we claim is:

1. In a method of transmitting measuring values in a fire alarm installation wherein measuring values determined by individual fire alarms connected in series at alarm reporting lines are transmitted in recurrent interrogation cycles to a central signal station beginning with a fire alarm closest to the central signal station and terminating with a last fire alarm located furthest from the central signal station, the transmitted measuring values are linked at the central signal station for obtaining differentiated disturbance or alarm signals, whereby at the start of each interrogation cycle for all fire alarms there is disconnected the alarm reporting line by a voltage change, then there is again reconnected in a time-wise staggered fashion the reporting lines such that each fire alarm after a certain time-delay connects a subsequently arranged fire alarm with the line voltage whereby there is caused an increase of current in the reporting line, and there is derived in an evaluation device from a number of preceding increases in the line current a momentary fire alarm address; the improvement which comprises the steps of:

returning the alarm reporting lines from the last fire alarm in each reporting line to terminals of the central signal station; and upon absence of fire alarm signals reversing an interrogation direction for the affected alarm reporting line.

2. The method as defined in claim 1, further including the steps of:

following the transmission of the measuring value of the last fire alarm of a reporting line feeding current into the alarm reporting lines from two different terminals of the central signal station.

3. The method as defined in claim 2, further including the steps of:

determining the time-delay by the measuring value of the fire alarm.

4. The method as defined in claim 2, wherein:

the time-delay is dependent upon the measuring value; and the measuring value is switched-through to the central signal station within the time-delay.

5. The method as defined in claim 1, further including the steps of:

determining the time-delay by the measuring value of the fire alarm.

6. The method as defined in claim 1, wherein:

the time-delay is dependent upon the measuring value; and the measuring value is switched-through to the central signal station within the time-delay.

7. The method as defined in claim 6, further including the steps of:

transmitting the measuring value to the central signal station in the form of a coded pulse train.

8. The method as defined in claim 6, further including the steps of:

transmitting the measuring value to the central signal station in the form of an alternating-current voltage signal at a frequency dependent upon the measuring value.

9. In an apparatus for transmitting measuring values in a fire alarm system, wherein: fire alarms are connected in series at alarm reporting lines with a central signal station, the central signal station serves for receiving measuring values detected by individual ones of the fire alarms and transmitted to the central signal station in recurrent interrogation cycles, and wherein the central signal station further serves for linking the measuring values to obtain differentiated disturbance and alarm signals, whereby at the start of one of each said interrogation cycle all of the fire alarms are disconnected from the alarm reporting line by a change in voltage and then again connected in a timewise staggered fashion such that each alarm, after a certain time delay, connects to the line voltage a subsequently arranged fire alarm whereby there is caused an increase of current in the reporting line, an evaluation device serving to derive a momentary alarm address from a number of preceding increases in the line current, the improvement which comprises:

said individual fire alarms each possessing two inputs for the connection of the alarm reporting lines; and each of said individual fire alarms containing time-delay circuit means which upon application of a potential at one of both inputs generates with a time-delay a signal at the other input.

10. The apparatus as defined in claim 9, further including:

a bidirectional switch provided for said time-delay circuit means.

11. The apparatus as defined in claim 10, wherein:

said bidirectional switch comprises a MOSFET transistor.

12. The apparatus as defined in claim 9, further including:

diode means for connecting the time-delay circuit means with terminals of the bidirectional switch.

* * * * *